US009174785B2

(12) United States Patent
Gelardi et al.

(10) Patent No.: US 9,174,785 B2
(45) **Date of Patent: *Nov. 3, 2015**

(54) PRODUCT DISPENSING SYSTEM WITH PANEL GUIDE

(75) Inventors: John Gelardi, Midlothian, VA (US); Bradford J. Walling, Chesterfield, VA (US); Aaron L. Bates, Moseley, VA (US); Laurel Thomas, Richmond, VA (US)

(73) Assignee: WestRock MWV, LLC, Norcross, GA (US)

( * ) Notice: Subject to any disclaimer, the term of this patent is extended or adjusted under 35 U.S.C. 154(b) by 358 days.

This patent is subject to a terminal disclaimer.

(21) Appl. No.: 13/032,734

(22) Filed: Feb. 23, 2011

(65) Prior Publication Data

US 2012/0211522 A1 Aug. 23, 2012

(51) Int. Cl.

| | |
|---|---|
| ***A47F 1/04*** | (2006.01) |
| ***B65D 71/36*** | (2006.01) |
| ***A47F 1/08*** | (2006.01) |
| ***B65D 5/72*** | (2006.01) |
| ***B65D 25/24*** | (2006.01) |
| ***G07F 11/28*** | (2006.01) |
| ***G07F 11/30*** | (2006.01) |

(52) U.S. Cl.

CPC ..... *B65D 71/36* (2013.01); *A47F 1/087* (2013.01); *B65D 5/725* (2013.01); *B65D 25/24* (2013.01); *G07F 11/28* (2013.01); *G07F 11/30* (2013.01); *A47F 1/04* (2013.01)

(58) Field of Classification Search

CPC ..... B65D 5/725; B65D 71/36; B65D 25/24; G07F 11/28; G07F 11/30; A47F 1/087; A47F 1/04

USPC ..... 211/59.2; 53/381.2; 83/946; 414/412, 414/414; 221/30, 31, 32

See application file for complete search history.

(56) References Cited

U.S. PATENT DOCUMENTS 902,347 A 10/1908 Tillinghast
1,004,998 A * 10/1911 Crecelius ..... 221/274

(Continued)

FOREIGN PATENT DOCUMENTS

DE 2655496 6/1978
DE 29808673 11/1998

(Continued)

OTHER PUBLICATIONS

International Search Report and Written Opinion issued in PCT/US2010/057020 (Mar. 8, 2011).

(Continued)

*Primary Examiner* — Joshua J Michener
*Assistant Examiner* — Devin Barnett
(74) *Attorney, Agent, or Firm* — WestRock IP Legal

(57) ABSTRACT

A product dispensing system including a container defining an internal volume and an opening into the internal volume, the container including a weakened severance line extending from the opening to define an access panel, and a dispenser including a frame and a catch element, the frame having a support deck and defining a recess sized to receive the access panel, the catch element being positioned to engage the opening in the container, separate the access panel from the container along the weakened severance line, and guide the separated access panel into the recess when the container is moved along the support deck.

13 Claims, 8 Drawing Sheets

(56) References Cited

U.S. PATENT DOCUMENTS 1,291,420 A 1/1919 Cough
1,383,318 A 7/1921 McCormick
1,393,964 A 10/1921 Potts
1,753,957 A 4/1930 Washburn
1,824,937 A 9/1931 Trouth
1,898,056 A 2/1933 Johnson
1,919,907 A 7/1933 Robinson
1,932,225 A 10/1933 Minter
1,941,458 A 2/1934 Bens
1,985,739 A 12/1934 Murray
2,078,599 A 4/1937 McCauley
2,110,194 A 3/1938 Blier
2,263,353 A 11/1941 Eidam
2,291,187 A 7/1942 Johnson
2,382,191 A 7/1944 Weichselbaum
2,536,421 A 2/1951 Burhans
2,573,331 A 10/1951 Arnold
2,574,087 A 11/1951 Burhans
2,595,122 A 4/1952 Burhans
2,732,619 A * 1/1956 Labine ..... 30/2
2,784,871 A 3/1957 Gabrielsen
2,795,845 A 6/1957 Shimer
2,818,978 A 1/1958 Post
2,826,471 A 3/1958 Fonda
2,831,591 A 4/1958 Morton
2,888,145 A 5/1959 Knott et al.
2,915,932 A 12/1959 Gross
2,919,488 A 1/1960 Brownlee
2,996,344 A 8/1961 Garman
3,018,149 A 1/1962 Parker
3,055,293 A 9/1962 Lariccia
3,066,827 A 12/1962 Pryor
3,137,068 A 6/1964 Quigley
D198,888 S 8/1964 Heselov
3,178,242 A 4/1965 Ellis et al.
3,184,104 A 5/1965 De Domenico et al.
3,203,554 A 8/1965 Pendergrast et al.
3,204,335 A 9/1965 Hughes
3,286,846 A * 11/1966 Brandes ..... 211/59.2
3,288,544 A 11/1966 Knecht
3,300,115 A 1/1967 Schauer
3,304,141 A 2/1967 Rogers
3,318,455 A 5/1967 Takahashi
3,335,940 A 8/1967 Dykes
3,340,790 A 9/1967 Simjian
3,348,738 A 10/1967 Hertieln
3,392,901 A 7/1968 Krzyzanowski
3,393,808 A 7/1968 Chirohill
3,501,016 A 3/1970 Eaton
3,763,557 A 10/1973 Sewell
3,784,022 A 1/1974 Beesley, Jr.
3,795,345 A * 3/1974 Baxendale ..... 221/125
3,922,778 A 12/1975 Aalpoel
3,923,159 A 12/1975 Taylor et al.
3,972,454 A 8/1976 Croley
4,105,126 A 8/1978 Deffner et al.
4,205,440 A 6/1980 Morgan
4,260,072 A 4/1981 Quasarano
4,318,458 A 3/1982 Ritsema
4,356,923 A * 11/1982 Young et al. ..... 211/59.2
4,382,526 A 5/1983 Stone
4,396,143 A 8/1983 Killy
4,435,026 A 3/1984 Johnson
4,467,524 A 8/1984 Ruff et al.
4,576,272 A 3/1986 Morgan, Jr.
4,598,828 A 7/1986 Young et al.
D290,790 S * 7/1987 Nathan et al. ..... D6/408
4,729,480 A 3/1988 Groover et al.
4,744,489 A 5/1988 Binder et al.
4,834,263 A 5/1989 Becze
4,869,395 A 9/1989 Rubbmark
4,911,309 A 3/1990 Stefan
4,915,571 A 4/1990 Toshihiko et al.
4,923,070 A 5/1990 Jackle et al.
4,997,106 A 3/1991 Rockola
4,998,628 A 3/1991 Ross
5,033,348 A 7/1991 Walsh
5,080,256 A 1/1992 Rockola
5,101,703 A 4/1992 Tanaka et al.
5,167,345 A 12/1992 Bleeker
5,190,155 A 3/1993 Grunwald
5,251,972 A 10/1993 Zurawin
5,289,943 A 3/1994 Powell
5,314,078 A 5/1994 Morikiyo et al.
5,328,258 A 7/1994 Scalise
5,356,033 A 10/1994 Delaney
5,372,278 A 12/1994 Leight
5,390,821 A 2/1995 Markel
5,396,997 A 3/1995 Johnson
D363,174 S 10/1995 Fletcher, Sr.
5,462,198 A 10/1995 Schwimmer
5,529,207 A 6/1996 Oden et al.
5,638,988 A 6/1997 Rogers
5,685,664 A 11/1997 Parham et al.
5,740,610 A 4/1998 Ayer et al.
5,788,117 A 8/1998 Zimmanck
5,791,048 A 8/1998 Bodnar et al.
5,836,478 A 11/1998 Weiss
5,878,862 A 3/1999 Dewsnap
5,894,942 A 4/1999 Miyashita et al.
5,924,573 A 7/1999 Piraneo et al.
5,992,286 A 11/1999 Boole
5,992,652 A 11/1999 Springs
6,186,345 B1 2/2001 Robertson
6,199,720 B1 3/2001 Rudick et al.
6,206,237 B1 3/2001 Dillon et al.
6,253,930 B1 7/2001 Freidus et al.
6,267,258 B1 7/2001 Wilkerson et al.
6,393,799 B2 5/2002 Jenkins et al.
6,502,408 B1 * 1/2003 Corcoran ..... 62/63
6,637,604 B1 10/2003 Jay
6,802,433 B2 10/2004 Leykin
6,991,116 B2 1/2006 Johnson et al.
7,207,447 B2 4/2007 Medcalf et al.
7,303,095 B2 12/2007 Nagelski et al.
7,546,973 B2 6/2009 Budz et al.
7,584,854 B2 9/2009 Chandaria
D604,972 S 12/2009 Henry et al.
7,665,618 B2 2/2010 Jay et al.
7,681,745 B2 3/2010 Richter
7,810,672 B1 10/2010 Mason et al.
7,823,733 B2 11/2010 Futori
7,850,015 B1 12/2010 Mason
7,913,860 B2 3/2011 Merl
7,918,365 B2 4/2011 White et al.
7,922,437 B1 4/2011 Loftin et al.
7,992,747 B2 * 8/2011 Bauer ..... 221/197
7,997,427 B2 * 8/2011 Lowenbraun et al. ..... 211/59.2
8,028,855 B2 10/2011 White et al.
8,047,400 B1 * 11/2011 Luberto et al. ..... 221/194
8,302,809 B1 * 11/2012 Bogdziewicz et al. ..... 221/31
8,448,815 B2 * 5/2013 Sholl et al. ..... 221/6
8,657,126 B1 * 2/2014 Loftin et al. ..... 211/59.2
8,668,114 B2 * 3/2014 Gelardi et al. ..... 221/285
8,714,373 B2 * 5/2014 Danehy ..... 211/74
8,925,744 B1 * 1/2015 Jang et al. ..... 211/59.2
2002/0043509 A1 4/2002 Lajeunesse et al.
2004/0011751 A1 1/2004 Johnson et al.
2004/0079760 A1 4/2004 Rink
2004/0262326 A1 12/2004 Christensen
2005/0092644 A1 5/2005 Cafferata
2005/0127015 A1 6/2005 Medcalf et al.
2005/0207877 A1 9/2005 Haverdink
2006/0081692 A1 4/2006 Stewart et al.
2006/0237384 A1 10/2006 Neumann et al.
2006/0278591 A1 12/2006 Tippets et al.
2007/0194037 A1 8/2007 Close
2008/0067188 A1 * 3/2008 White et al. ..... 221/123
2008/0245813 A1 10/2008 Johnson et al.
2009/0212066 A1 8/2009 Bauer
2009/0266776 A1 10/2009 Johnson
2009/0277853 A1 11/2009 Bauer
2009/0308885 A1 * 12/2009 Sainato et al. ..... 221/194
2010/0032391 A1 2/2010 Schneider et al.

(56) References Cited

U.S. PATENT DOCUMENTS

| | | | | |
|---|---|---|---|---|
| 2010/0096401 | A1* | 4/2010 | Sainato et al. | 221/8 |
| 2011/0121010 | A1 | 5/2011 | Loftin et al. | |
| 2011/0121011 | A1 | 5/2011 | Gelardi et al. | |
| 2011/0147323 | A1* | 6/2011 | Sainato et al. | 211/59.2 |
| 2012/0074160 | A1* | 3/2012 | Thomas et al. | 221/1 |
| 2012/0074164 | A1* | 3/2012 | Walling et al. | 221/282 |
| 2012/0097694 | A1* | 4/2012 | Gelardi | 221/1 |
| 2012/0211522 | A1* | 8/2012 | Gelardi et al. | 222/173 |
| 2012/0217213 | A1* | 8/2012 | Thomas | 211/59.2 |
| 2012/0217261 | A1* | 8/2012 | Bailey et al. | 221/282 |
| 2012/0223090 | A1* | 9/2012 | Thomas et al. | 221/1 |
| 2012/0285977 | A1* | 11/2012 | Bates et al. | 221/1 |
| 2013/0020341 | A1* | 1/2013 | Bogdziewicz et al. | 221/1 |
| 2013/0134177 | A1* | 5/2013 | Loftin | 221/1 |
| 2013/0221017 | A1* | 8/2013 | Zacherle et al. | 221/1 |
| 2013/0233813 | A1* | 9/2013 | Zacherle et al. | 211/59.2 |
| 2013/0248468 | A1* | 9/2013 | Burton et al. | 211/59.2 |
| 2013/0264351 | A1* | 10/2013 | Bogdziewicz et al. | 221/1 |
| 2013/0277321 | A1* | 10/2013 | Zacherle et al. | 211/59.2 |
| 2013/0277385 | A1* | 10/2013 | Zacherle | 221/197 |
| 2013/0313951 | A1* | 11/2013 | Stewart et al. | 312/45 |
| 2014/0001200 | A1* | 1/2014 | Bates et al. | 221/191 |
| 2014/0054249 | A1* | 2/2014 | Loftin | 211/59.2 |
| 2014/0054309 | A1* | 2/2014 | Loftin | 221/1 |
| 2014/0076922 | A1* | 3/2014 | Binshtok et al. | 221/285 |
| 2014/0190912 | A1* | 7/2014 | Bauer | 211/59.2 |

FOREIGN PATENT DOCUMENTS

| | | | |
|---|---|---|---|
| DE | 19808162 | | 9/1999 |
| DE | 20111307 | | 10/2001 |
| DE | 202007012114 | | 11/2007 |
| GB | 2190906 | | 12/1987 |
| GB | 2303624 | | 2/1997 |
| JO | 03273477 | A | 12/1991 |
| JO | 10269421 | A | 10/1998 |
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273474 | A | 12/1991 |
| JP | 03273476 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO 2009138538 | | 11/2009 |
| WO | WO 2011025483 | | 3/2011 |
| WO | WO 2011109350 | | 9/2011 |

OTHER PUBLICATIONS

International Search Report and Written Opinion issued in PCT/US2010/057221 (Mar. 4, 2011).

International Search Report and Written Opinion issued in PCT/US2012/020709.

* cited by examiner

PRODUCT DISPENSING SYSTEM WITH PANEL GUIDE

FIELD

This application relates to the dispensing of products from packaging containers and, more particularly, to product dispensers configured to cooperate with packaging containers to dispense products.

BACKGROUND

Products are typically shipped to retailers in bulk by enclosing multiple individual product units in a container, such as a carton or box. For example, canned foods may be shipped to a retailer in a box containing twenty-four individual cans. Then, it is typically the retailer's obligation to remove the individual product units from the container and present them (e.g., on a shelf) to consumers.

Alternatives to the traditional package-ship-unpack-display model are being developed in an effort to improve operating efficiency. For example, U.S. patent application Ser. No. 12/777,444 filed on May 11, 2010, the entire contents of which are incorporated herein by reference, discloses a new system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that product rolls from the container and down to the product display area of the frame under the force of gravity. As another example, U.S. patent application Ser. No. 12/891,391 filed on Sep. 27, 2010, the entire contents of which are incorporated herein by reference, discloses a product dispensing system that utilizes an opening tool having a catch element that engages and opens a container as the container is loaded onto the dispenser.

Despite advances already made in the field, those skilled in the art continue with research and development efforts directed to apparatus and systems for dispensing products from packaging containers.

SUMMARY

In one aspect, the disclosed product dispensing system may include a container and a dispenser. The container may define an internal volume and an opening into the internal volume. The container may include a weakened severance line extending from the opening to define an access panel. The dispenser may include a frame and a catch element. The frame may include a support deck and may define a recess sized to receive the access panel. The catch element may be positioned to engage the opening in the container, separate the access panel from the container along the weakened severance line, and guide the separated access panel into the recess when the container is moved along the support deck.

In another aspect, the disclosed product dispenser may include a frame defining a recess and comprising a support deck having a front end and a rear end, the support deck defining an opening into the recess, and a catch element connected to the support deck proximate the opening, the catch element protruding toward the front end and including a guide configured to guide an access panel toward the opening and into the recess.

In yet another aspect, the disclosed product dispensing system may include a container including a plurality of walls that define an internal volume, wherein a base wall of the plurality of walls defines an opening into the internal volume, and wherein the base wall includes at least two weakened severance lines extending from the opening to define an access panel, and a dispenser including a frame including a support deck having a front end and a rear end, the frame defining a recess sized to receive the access panel, and a catch element connected to the support deck proximate the rear end, the catch element protruding toward the front end to engage the opening in the container, separate the access panel from the container along the weakened severance lines, and guide the separated access panel into the recess when the container is moved along the support deck from the front end toward the rear end.

Other aspects of the disclosed product dispensing system and associated product dispenser will become apparent from the following detailed description, the accompanying drawings and the appended claims.

DETAILED DESCRIPTION

Figure 1:
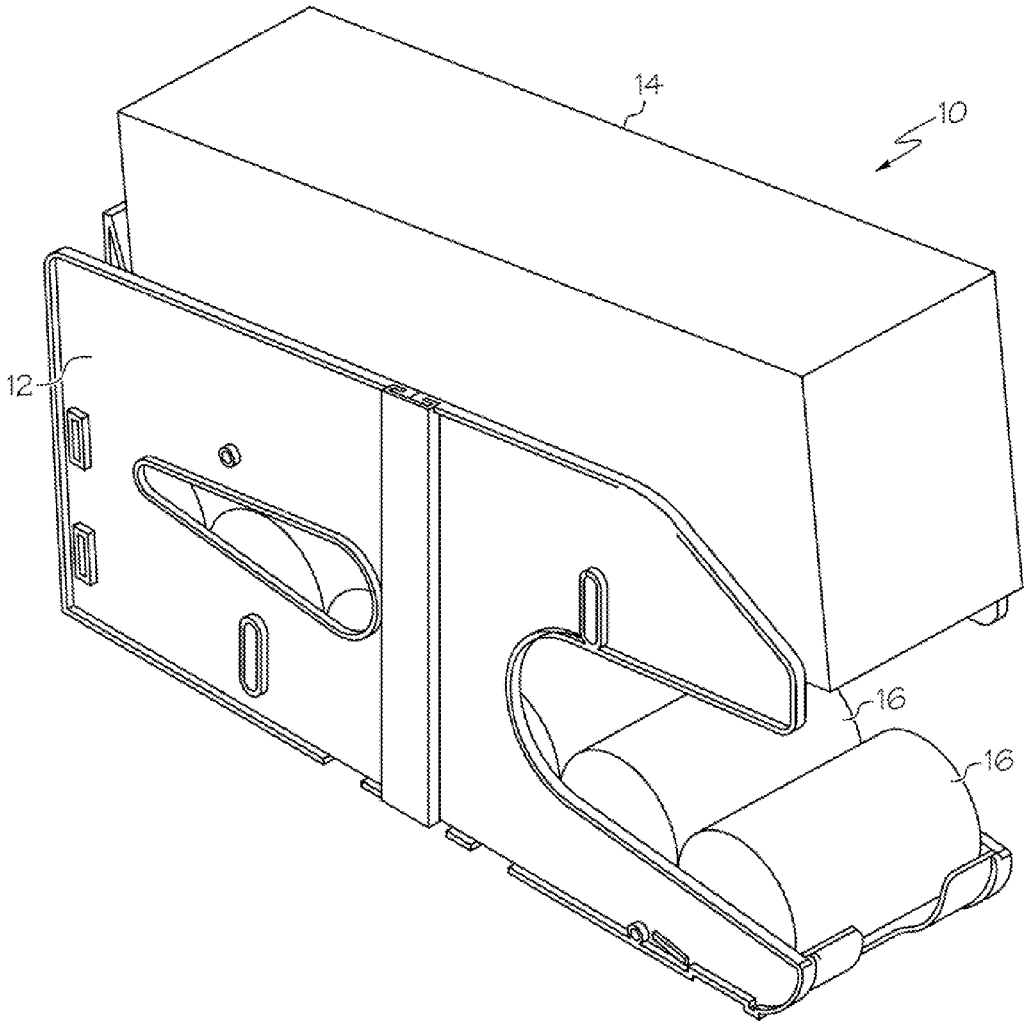
FIG. 1 is a side perspective view of one aspect of the disclosed product dispensing system with panel guide.

Referring to FIG. 1, one aspect of the disclosed product dispensing system with panel guide, generally designated 10, may include a dispenser 12 and a container 14. The container 14 may house multiple units of product 16, such as cans (e.g., canned soup), jars (e.g., jarred sauce) or bottles (e.g., bottled soft drinks). Therefore, as the container 14 is loaded onto the dispenser 12 by urging the container 14 horizontally along the dispenser 12, the dispenser 12 may engage and open the container 14, thereby releasing the products 16 from the container 14 into the dispenser 12 without the container 14 interfering with movement of the products 16 from the container 14 and through the dispenser 12.

The container 14 may be any container capable of housing products 16 and beneficially interacting with the disclosed dispenser 12. For example, the container 14 may be a paperboard carton or a corrugated box.

Figure 2:
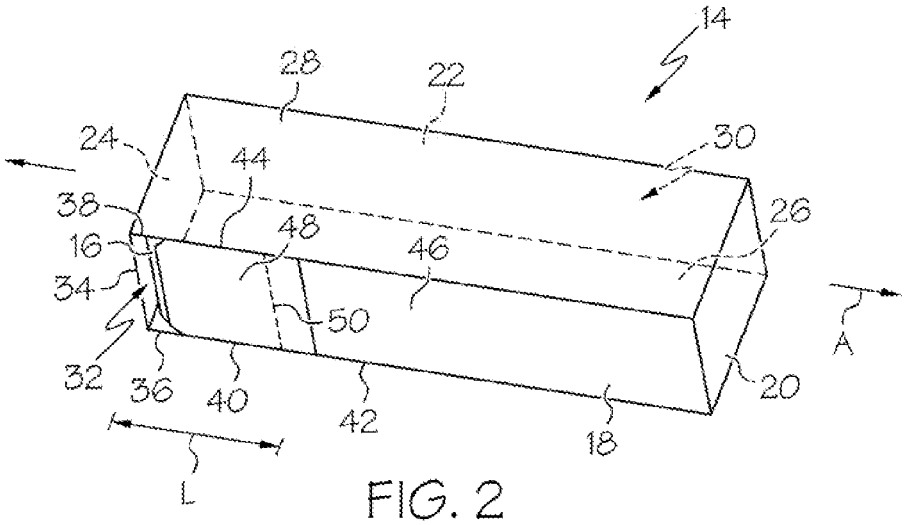
FIG. 2 is a bottom perspective view of the container of the product dispensing system of FIG. 1.

As shown in FIG. 2, in one construction, the container 14 may be a generally rectilinear container having six walls 18, 20, 22, 24, 26, 28 that define an internal volume 30 for receiving the products 16. Opposed walls 20 and 24 may define the front and rear walls, respectively, of the container 14. Opposed walls 26 and 28 may define the first (e.g., right) and second (e.g., left) side walls, respectively, of the container 14. Opposed walls 18 and 22 may define the base and upper walls, respectively, of the container 14.

In accordance with well-established techniques, the container 14 may be assembled on a container machine using a container blank that has been pre-cut from a sheet of stock material. As one example, the stock material may be a paperboard-based material, such as C1S paperboard, which may have a coating (e.g., clay) on a first major surface thereof, which may form the outer surface of the container 14, and an uncoated second major surface. As another example, the stock material may be C2S paperboard, which may have a coating (e.g., clay) on both major surfaces thereof. Optionally, at least one major surface of the container blank may be marked with various indicia, such as printed text and graphics.

In one implementation, the base wall 18 of the container 14 may define a pre-formed opening 32 into the internal volume 30 of the container 14. For example, the opening 32 may be formed proximate (i.e., at or near) the rear wall 24 of the container 14, such as along the edge 34 between the base wall 18 and the rear wall 24.

In another implementation, the base wall 18 of the container 14 may include a removable feature (not shown) that, when removed from the container 14, reveals an opening 32 into the internal volume 30 of the container 14. For example, the removable feature may be a zipper strip or a peelable label.

The opening 32 may extend generally laterally between the side walls 26, 28 of the container 14. For example, the opening 32 may include a first (e.g., right) end 36 positioned proximate the right side wall 26 of the container 14 and a second (e.g., left) end 38 positioned proximate the left side wall 28 of the container 14.

Those skilled in the art will appreciate that the opening 32 may be positioned at various alternative locations and may have various alternative configurations, provided that the opening 32 is capable of being engaged by the dispenser 12 when the container 14 is being loaded onto the dispenser 12. As a first alternative implementation, the opening 32 may be formed in the rear wall 24 of the container 14. As a second alternative implementation, the opening 32 may be formed in the base wall 26, between the front 20 and rear 24 walls of the container 14. Other implementations are also contemplated.

A first row of perforations 40 may extend generally longitudinally from the opening 32 toward the front wall 20 of the container 14. For example, the first row of perforations 40 may be formed in the base wall 18 proximate the edge 42 between the base wall 18 and the right side wall 26. The first row of perforations 40 may have a length L that is greater than the greatest diameter of the products 16 housed in the container 14, but less than the longitudinal length of the base wall 18 (i.e., the length of the base wall 18 along the longitudinal axis A of the container 14).

A second row of perforations 44 may also extend generally longitudinally from the opening 32 toward the front wall 20 of the container 14. For example, the second row of perforations 44 may be formed in the base wall 18 proximate the edge 46 between the base wall 18 and the left side wall 28. Like the first row of perforations 40, the second row of perforations 44 may have a length L that is greater than the greatest diameter of the products 16 housed in the container 14, but less than the longitudinal length of the base wall 18.

The first 40 and second 44 rows of perforations may be formed using various types of perforations. As a first example, the first 40 and second 44 rows of perforations may be formed as zipper-like cuts. As a second example, the first 40 and second 44 rows of perforations may be formed as standard perforations. As a third example, the first 40 and second 44 rows of perforations may be formed as micro perforations. While specific mention is made of perforations, those skilled in the art will appreciate that any technique or structure capable of forming weakened severance lines may be used in place of rows of perforations without departing from the scope of the present disclosure.

Figure 3:
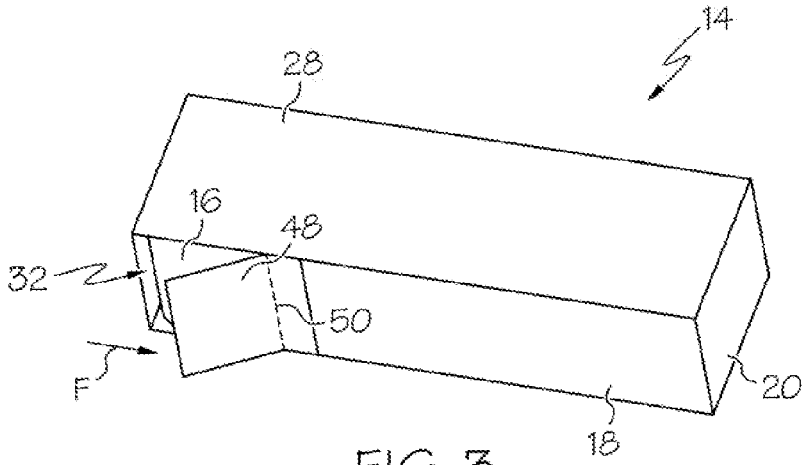
FIG. 3 is a bottom perspective view of the container of FIG. 2, shown in a partially opened configuration.
Figure 4:
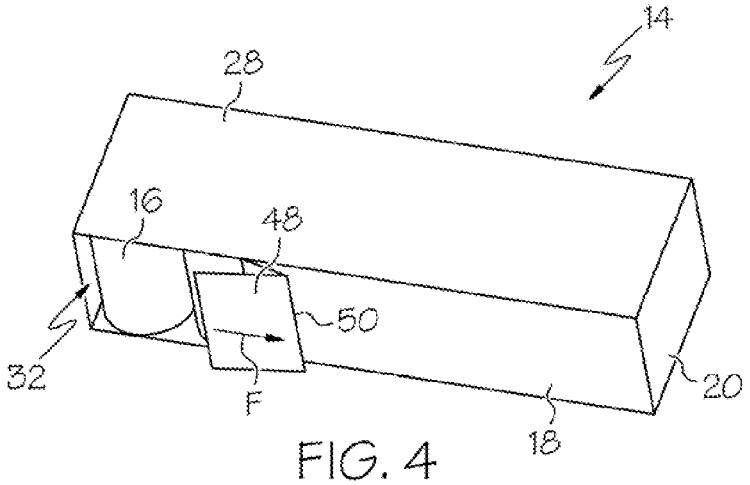
FIG. 4 is a bottom perspective view of the container of FIG. 2, shown in a fully opened configuration.

Referring to FIGS. 3 and 4, a pulling force F applied to the base wall 18 at the opening 32 may partially separate a portion of the base wall 18 from the container 14 along the first 40 and second 44 rows of perforations to form an access panel 48. As the access panel 48 is separated from the remainder of the container 14 and urged toward the front of the container 14 (i.e., toward the front wall 20), the size of the opening 32 may be significantly increased, thereby allowing the products 16 housed in the container 14 to be dispensed from the container 14 by way of the larger opening 32.

Optionally, a preformed fold line 50 may laterally extend across the access panel 48 to encourage the access panel 48 to fold as the access panel 48 is being urged toward the front of the container 14. Those skilled in the art will appreciate that providing a preformed fold line 50 may reduce or eliminate the possibility that the access panel 48 will randomly fold or bunch-up as the access panel 48 is formed and urged toward the front of the container 14.

Figure 5:
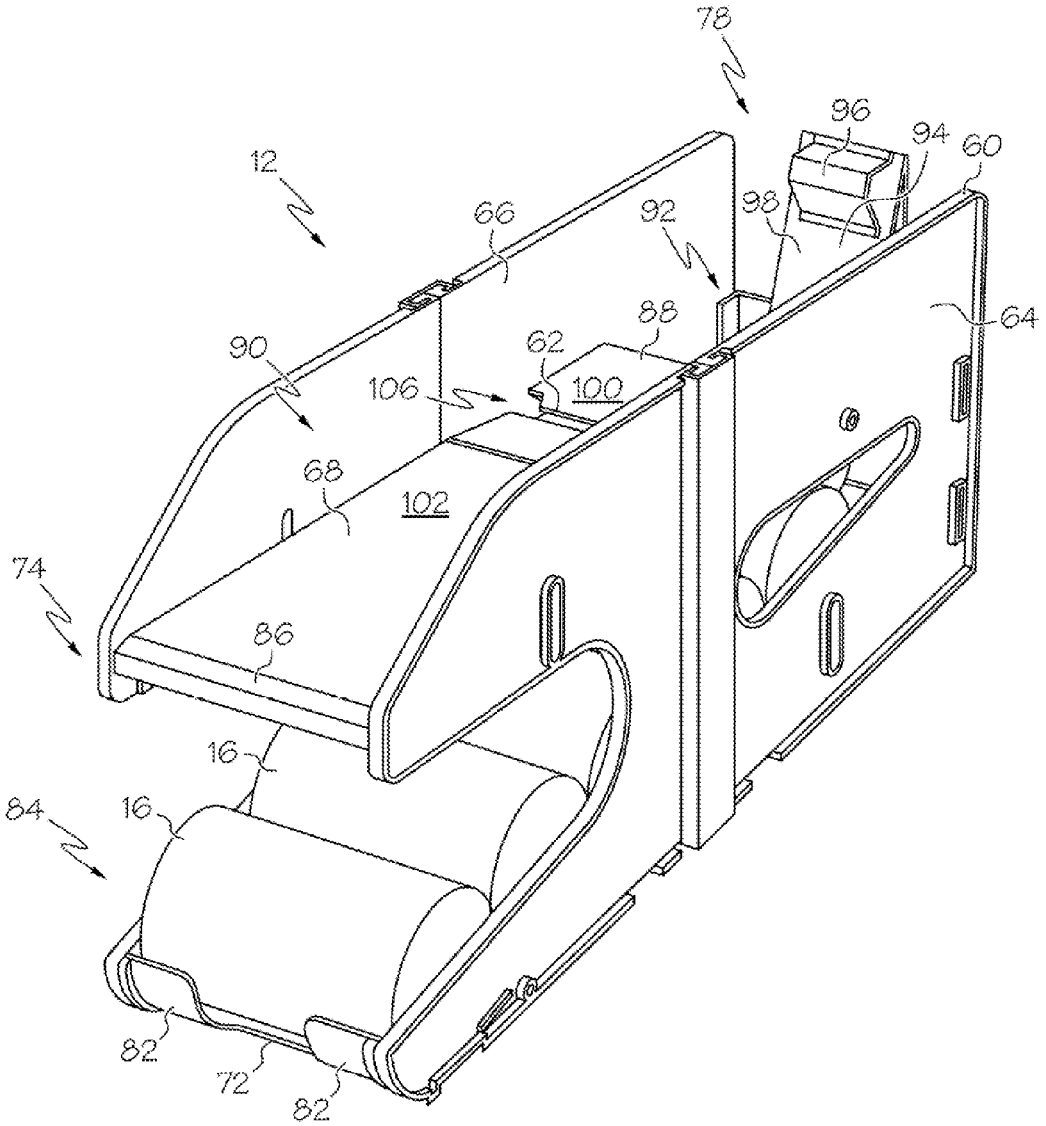
FIG. 5 is front perspective view of the dispenser of the product dispensing system of FIG. 1.
Figure 6:
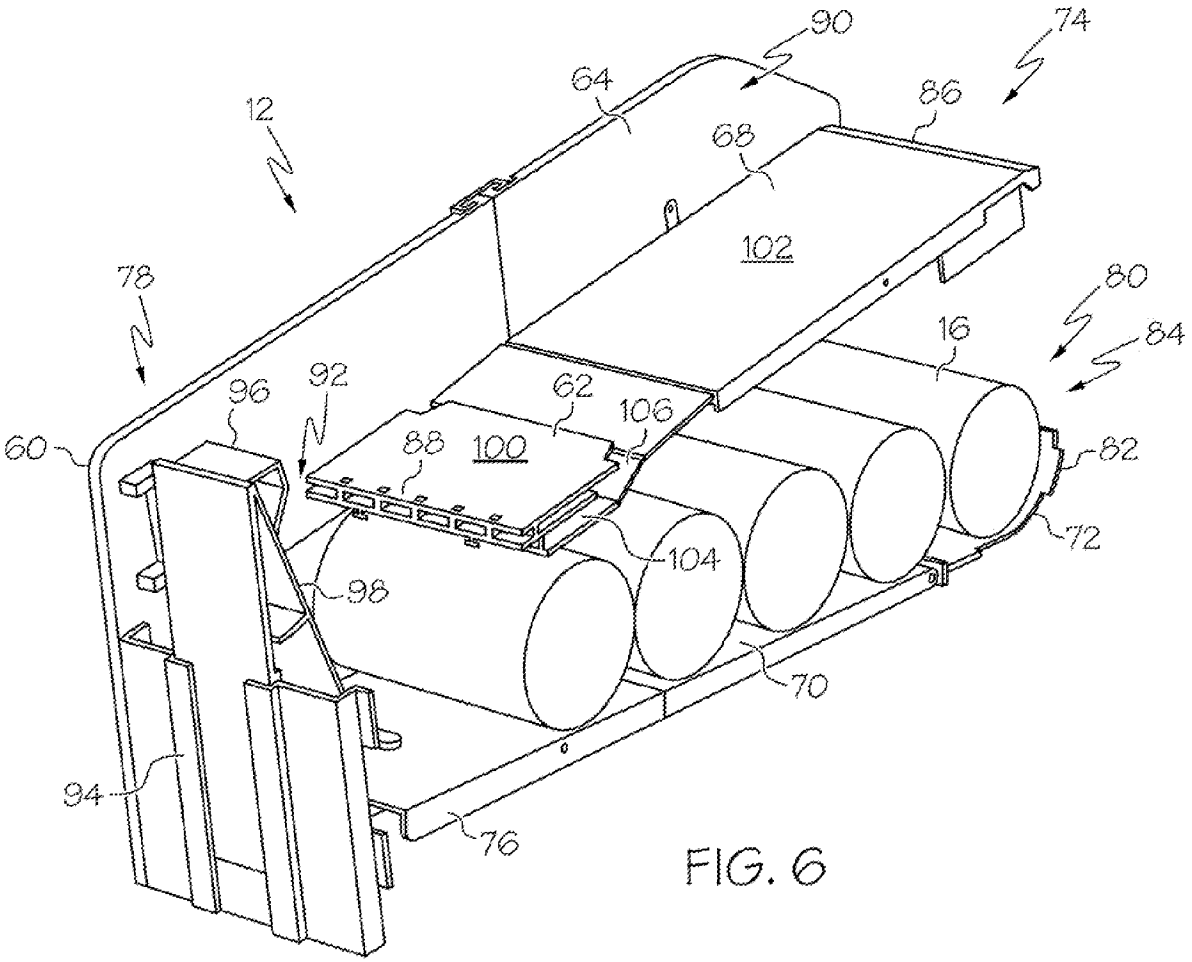
FIG. 6 is a rear perspective view of the dispenser of FIG. 5, shown with a side wall removed therefrom.

Referring to FIGS. 5 and 6, the dispenser 12 may include a frame 60 and a catch element 62. The frame 60 of the dispenser 12 may support the container 14 in a desired configuration, as shown in FIG. 1. The catch element 62 may engage the opening 32 (FIG. 2) in the container 14 to separate the access panel 48 from the container 14 as the container 14 is loaded onto the frame 60, as is described in greater detail herein.

Those skilled in the art will appreciate that the dispenser 12 may include additional components and features, such as one or more of the components and features of the dispensers disclosed in U.S. Ser. No. 12/777,444, without departing from the scope of the present disclosure.

The frame 60 may include a first (e.g., right) side wall 64, a second (e.g., left) side wall 66, an upper support deck 68 and a lower support deck 70. The right side wall 64 may be laterally spaced from the left side wall 66, and may be generally parallel with the left side wall 66.

The lower support deck 70 may laterally extend between the right 64 and left 66 side walls, and may include a front end 72 that longitudinally extends toward the front end 74 of the frame 60 and a rear end 76 that longitudinally extends toward the rear end 78 of the frame 60. Therefore, the lower support deck 70 and the side walls 64, 66 may define a lower level 80 of the frame 60.

The lower support deck 70 may be inclined from the front end 72 to the rear end 76 (i.e., the rear end 76 may be elevated relative to the front end 72) such that products 16 deposited proximate the rear end 76 of the lower support deck 70 roll down to the front end 72 of the lower support deck 70 under the force of gravity. The extent of the incline of the lower support deck 70 may be dictated by, among other things, the coefficient of friction of the material used to form the frame 60 and the shape of the products 16 to be dispensed by the dispenser 12.

One or more stops 82 may be positioned proximate the front end 72 of the lower support deck 70 to prevent products 16 from rolling beyond the front end 72 of the lower support deck 70. For example, the stops 82 may be connected to (e.g., integral with) the lower support deck 70, and may form an upward curve at the front end 72 of the lower support deck 70. Therefore, the stops 82 may collect products 16 at the front end 72 of the lower support deck 70, thereby defining a product display area 84 at the front end 72 of the lower support deck 70.

The upper support deck 68 may laterally extend between the right 64 and left 66 side walls, and may include a front end 86 that longitudinally extends toward the front end 74 of the frame 60 and a rear end 88 that longitudinally extends toward, but not to, the rear end 78 of the frame 60. Therefore, the upper support deck 68 and the side walls 64, 66 may define an upper level 90 of the frame 60.

The spacing between the rear end 88 of the upper support deck 68 and the rear end 78 of the frame 60 may define an opening 92, which may function as a chute to allow products 16 to move from the upper level 90 to the lower level 80 of the frame 60.

The upper support deck 68 may be declined from the front end 86 to the rear end 88 (i.e., the front end 86 may be elevated relative to the rear end 88). Therefore, products 16 supported by the upper support deck 68 may roll under the force of gravity down to the rear end 88 of the upper support deck 68, through the opening 92, to the lower level 80 of the frame 60 and, ultimately, to the product display area 84.

Figure 7:
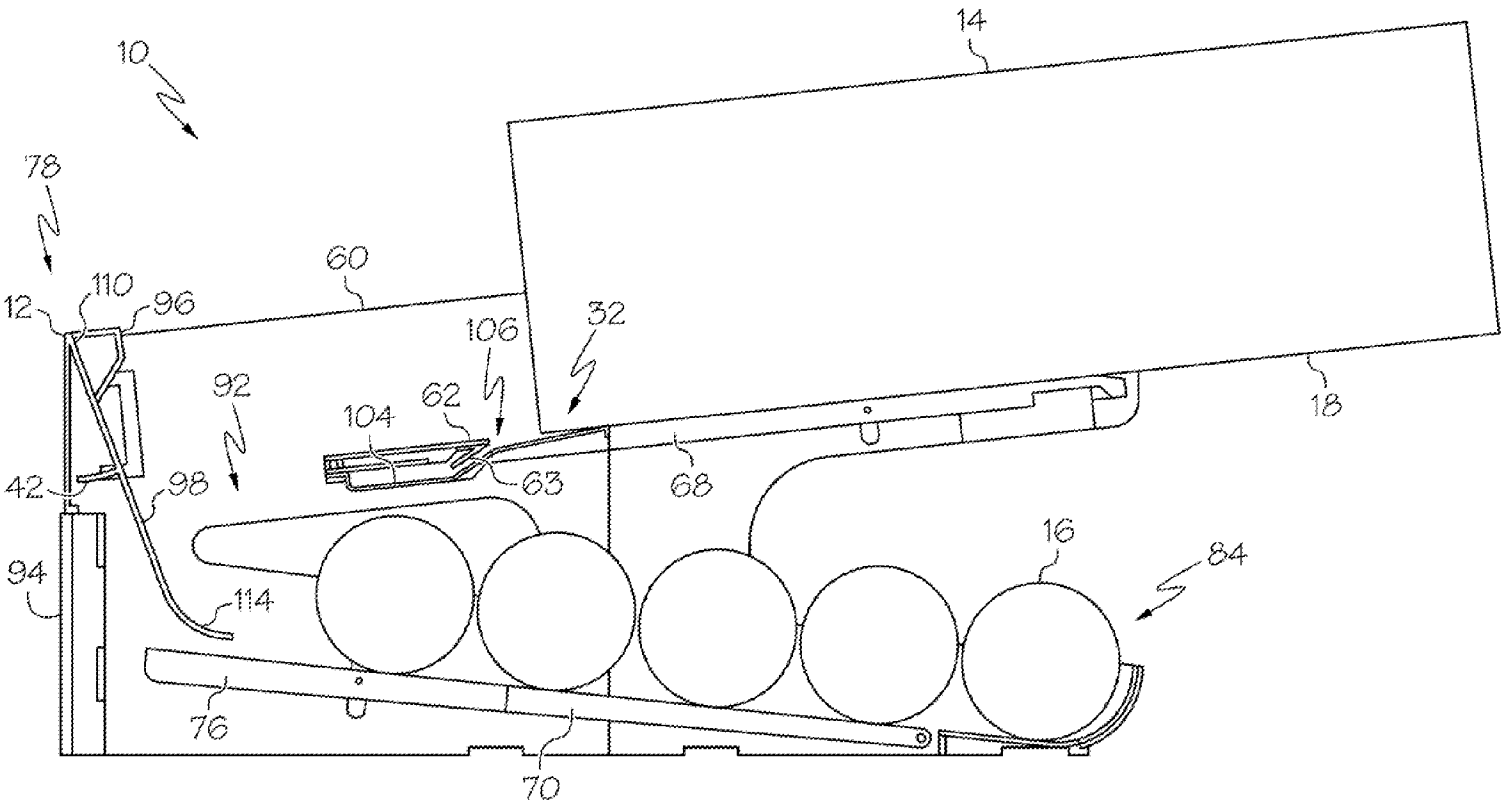
FIG. 7 is a side elevational view of the dispenser of FIG. 6, shown with the container in a first, partially loaded configuration.

Referring to FIGS. 6 and 7, an optional rear wall 94 may be positioned at the rear end 78 of the frame 60 between the right 64 and left 66 side walls. The rear wall 94 may include a stop 96 that inhibits rearward horizontal movement of the container 14 (FIG. 1) along the upper support deck 68 beyond the stop 96.

A guide 98 may be connected to the rear wall 94 of the frame 60, and may extend through the opening 92 in the frame 60, from the upper level 90 to the lower level 80. The guide 98 may be positioned to receive products 16 exiting the container 14 and passing through the opening 92 in the frame 60, and may guide the products 16 to the rear end 76 of the lower support deck 70.

Optionally, the guide 98 may be springingly connected to the rear wall 94 of the frame 60 at a connection point 110, and may include a protrusion 112 extending toward the rear wall 94. As a product 16 drops into engagement with the receiving end 114 of the guide 98, the force of the product 16 acting on the guide 98 may urge the guide 98, and specifically the protrusion 112, into engagement with the rear wall 94. Therefore, as the guide 98 receives a product 16, the guide 98 may effect a "tapping" of the rear wall 94. The vibration of the "tapping" may be transferred throughout the system 10, including the products 16 remaining in the container 14, thereby encouraging products 16 to move from the container 14 to the dispenser 12. As the product 16 disengages the guide 98 and moves toward the product display area 84, the spring-loaded guide 98 may return to its original position (FIG. 7) to await another dispensing product 16.

The catch element 62 may be position in the upper level 90 of the frame 60 to engage the opening 32 in the container 14 and separate the access panel 48 from the container 14 as the container 14 is moved horizontally along the upper support deck 68 toward the rear end 78 of the frame 60. The shape and position of the catch element 62 may be configured such that a portion of the catch element 62 may extend through the opening 32 in the container 14 to releasably engage the base wall 18 of the container 14 proximate the opening 32 as the container 14 is moved horizontally along the upper support deck 68, thereby facilitating the separation of the access panel 48 from the container 14 along the first 40 and second 44 rows of perforations and, ultimately, the formation of a larger opening 32 sufficient to release the products 16 from the container 14.

In one construction, the catch element 62 may be connected to the upper support deck 68 of the frame 60 proximate the rear end 88 of the upper support deck 68, and may laterally extend between the side walls 64, 66 of the frame 60. The catch element 62 may longitudinally protrude from the upper support deck 68 toward the front end 74 of the frame 60.

In an effort to minimize interference between the catch element 62 and the container 14 during loading, while still allowing the catch element 62 to engage the opening 32 of the container 14, the upper surface 100 of the catch element 62 may define a plane that is substantially co-planar with a plane defined by the upper surface 102 of the upper support deck 68. However, those skilled in the art will appreciate that slight displacement and/or a slight angle of the plane defined by the upper surface 100 of the catch element 62 relative to the plane defined by the upper surface 102 of the upper support deck 68 may encourage engagement of the opening 32 in the container 14 by the catch element 62.

While the catch element 62 is shown and described as a generally flat, laterally elongated protrusion, those skilled in the art will appreciate that various alternative structures may be used as the disclosed catch element 62 without departing from the scope of the present disclosure. For example, suitable catch elements 62 may include various hooks, protrusions, flanges, detents and the like sufficient to engage the opening 32 in the container 14 and to peel back the access panel 48 of the container 14 while the container 14 is being loaded onto the dispenser 12.

The upper support deck 68 may define a recess 104 and an opening 106 to the recess 104. The recess 104 may be positioned below the upper surface 102 of the upper support deck 68, and may extend from proximate the catch element 62 toward the rear end 88 of the upper support deck 68. The recess 104 may be sized and shaped to receive the entire access panel 48 of the container 14, or at least a significant portion (e.g., at least 70 percent or at least 80 percent) thereof. For example, the recess 104 may be an enclosed (or open) chamber or an open channel sized to receive the access panel 48. The opening 106 to the recess 104 may be positioned proximate the catch element 62, such as immediately below the catch element 62, and may be shaped to guide the access panel 48 to the recess 104. The catch element 62 may optionally include a guide 63 to guide the access panel 48 to the opening 106 and into the recess 104.

Figure 8:
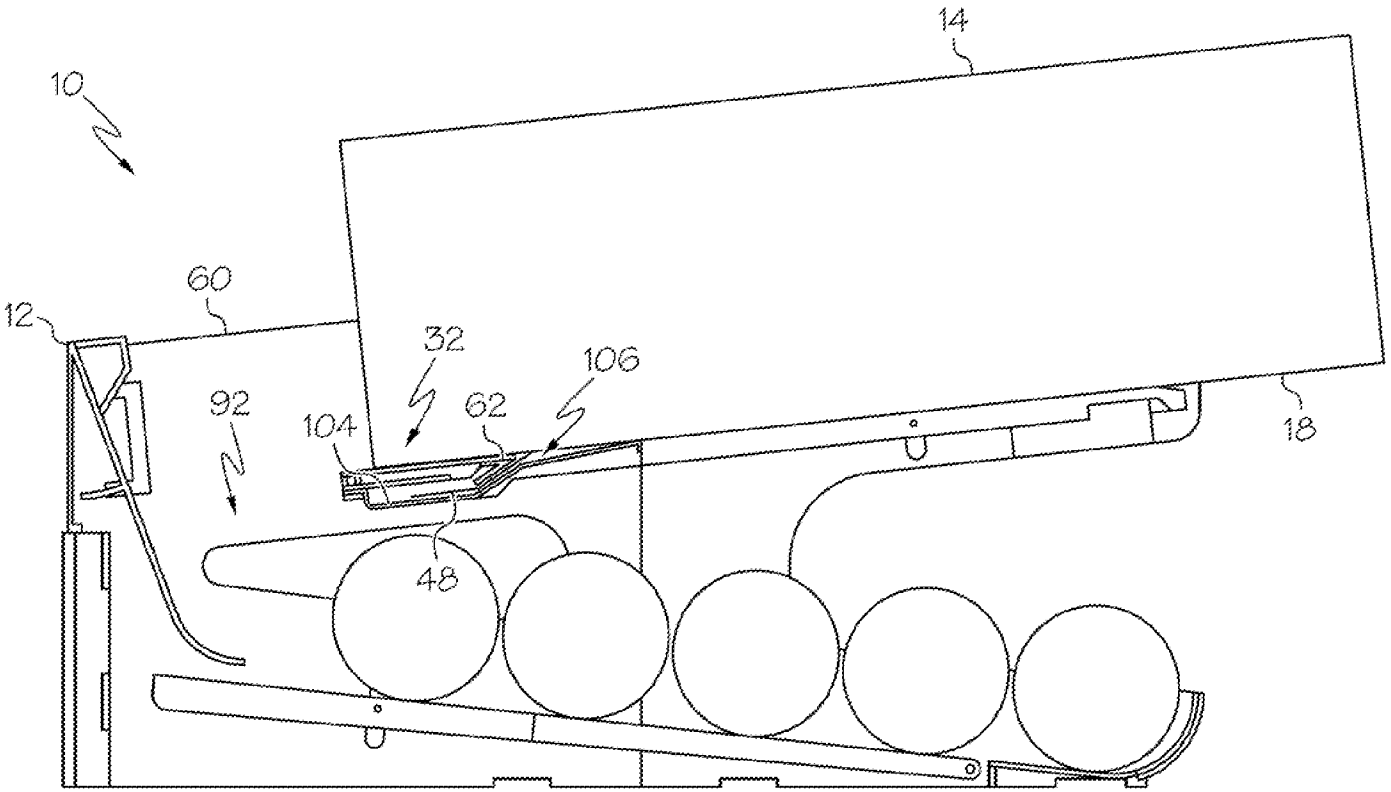
FIG. 8 is a side elevational view of the dispenser of FIG. 7, shown with the container in a second, partially loaded configuration.

The container 14 may be loaded onto the dispenser 12 by horizontally urging the container 14 along the upper support deck 68 of the dispenser frame 60, as shown in FIG. 7. As the opening 32 in the container 14 approximates the catch element 62 of the dispenser 12, the catch element 62 may extend through the opening 32 and may begin to separate the access panel 48 from the base wall 18 of the container 14, as shown in FIG. 8. As the access panel 48 is separated from the base wall 18 of the container 14, the catch element 62 may guide the separated access panel 48 through the opening 106 in the upper support deck 68 and, ultimately, into the recess 104.

Figure 9:
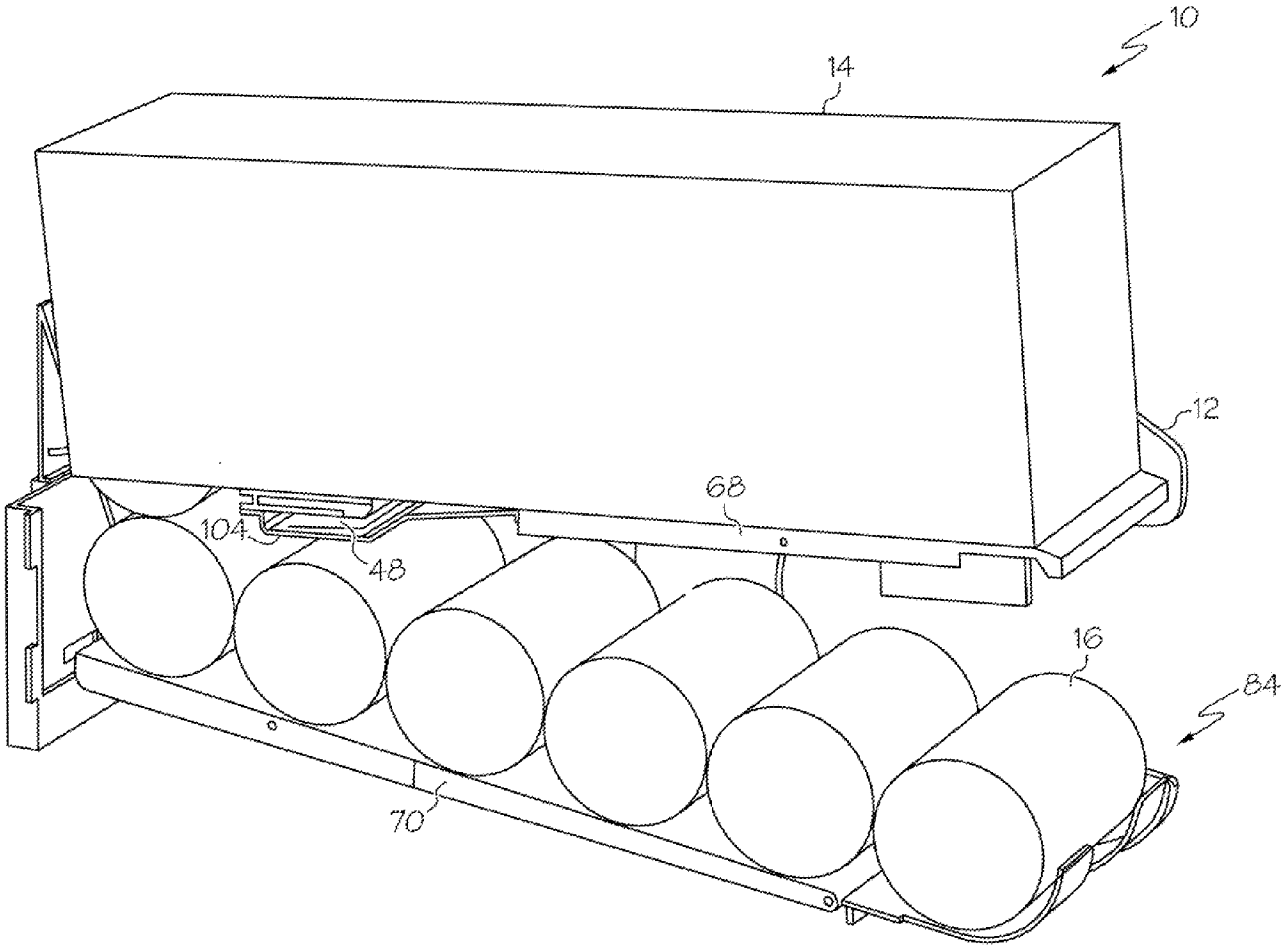
FIG. 9 is a side perspective view of the dispenser of FIG. 8, shown with the container in a fully loaded configuration.

Referring to FIG. 9, once the container 14 has been fully loaded onto the dispenser 12, the access panel 48 may be sufficiently removed and received in the recess 104, thereby allowing the products 16 housed in the container 14 to exit the container 14 by way of the expanded opening 32 in the container 14, pass through the opening 92 in the frame 60 to the lower level 80 of the frame 60, and roll along the lower support deck 70 to the product display area 84.

Accordingly, by providing a recess 104 for receiving the access panel 48 as the access panel 48 is separated from the container 14 and guiding the access panel 48 into the recess 104, the disclosed product dispensing system 10 may prevent the separated access panel 48 from interfering with the operation of the system 10, such as by unintentionally engaging products 16 moving through the dispenser 12 or from altering the angle of the container 14 as is rests on the dispenser 12.

Figure 10:
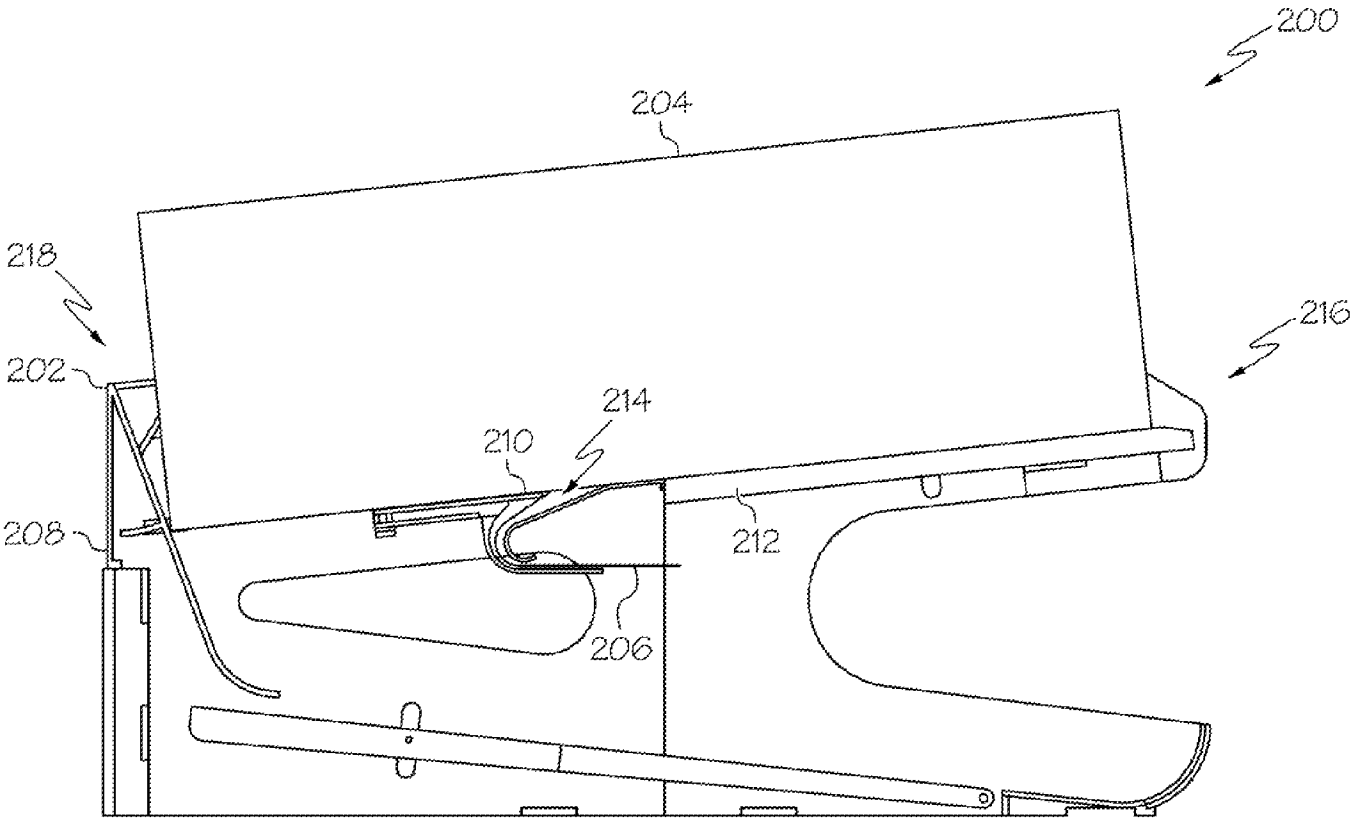
FIG. 10 is a side elevational view of a second aspect of the disclosed product dispensing system with panel guide.

Referring to FIG. 10, another aspect of the disclosed product dispensing system with panel guide, generally designated 200, may include a dispenser 202 and a container 204. The container 204 may be the same as, or similar to, the container 14 shown in FIG. 2, and may include an access panel 206 that is at least partially separable from the container 204. Therefore, like dispenser 12, dispenser 202 may be configured to beneficially guide the access panel 206 during loading of the container 204 onto the dispenser 202 such that the access panel 206 does not interfere with the operation of the product dispensing system 200.

Specifically, the dispenser 202 may include a frame 208 and a catch element 210. The frame 208 may include an upper support deck 212, and may define a recess 214 for receiving the separated access panel 206 as the container 204 is loaded onto the dispenser 202. The recess 214 may be curved such that the access panel 206 is directed toward the front end 216 of the dispenser frame 208 as the container 204 is horizontally urged toward the rear end 218 of the dispenser frame 208.

Thus, the disclosed product dispensing system 200 may beneficially redirect the separated access panel 206 during loading of the container 204 onto the dispenser 202 such that the separated access panel 206 does not interfere with the dispensing of products.

Although various aspects of the disclosed product dispensing system with panel guide have been shown and described, modifications may occur to those skilled in the art upon reading the specification. The present application includes such modifications and is limited only by the scope of the claims.

What is claimed is:

1. A product dispensing system comprising:

a container comprising a plurality of walls defining an internal volume, wherein said container defines a preformed opening into said internal volume, and wherein said container comprises a weakened severance line extending from said opening to define an access panel in said container, wherein products are adapted to be stored within the internal volume of the container; and a dispenser comprising:

a frame having a front end and a rear end, the frame comprising a support deck, the support deck being configured to support the container, the support deck having a front end and a rear end, said support deck comprises a recess located between the front end and rear end of the support deck, the recess being sized to receive said access panel wherein the recess has a curved channel; and a catch element connected to said support deck proximate to the rear end of the support deck, said catch element protruding toward the front end of the frame to at least partially pass into said interior volume of the container through said opening, separate said access panel from said container along said weakened severance line, and guide said separated access panel into the curved channel of said recess and toward said front end of the support deck when said container is moved along said support deck from said support deck front end toward said support deck rear end, thereby causing the products adapted to be stored within the internal volume of the container to be dispensed out of the opening of the container.

2. The product dispensing system of claim 1 further comprising a plurality of products received in said internal volume.

3. The product dispensing system of claim 1 wherein said container comprises paperboard.

4. The product dispensing system of claim 1 wherein said container comprises two weakened severance lines extending generally in parallel from said opening.

5. The product dispensing system of claim 1 wherein said weakened severance line comprises perforations.

6. The product dispensing system of claim 1 wherein said plurality of walls comprises at least a base wall, an upper wall opposite said base wall, and a rear wall, and wherein said opening is defined in said container proximate an edge between said base wall and said rear wall.

7. The product dispensing system of claim 1 wherein said plurality of walls comprises at least a base wall, an upper wall opposite said base wall, and a rear wall, and wherein said opening is defined in said base wall.

8. The product dispensing system of claim 1 wherein said front end of the support deck is elevated relative to said rear end of the support deck.

9. The product dispensing system of claim 1 wherein said support deck defines an opening to said recess proximate said catch member.

10. The product dispensing system of 9 wherein said recess extends from said opening toward said rear end of said support deck.

11. The product dispensing system of claim 1 wherein said frame further comprises a second support deck positioned below said support deck, said second support deck comprising a front end and a rear end, said front end of said second support defining said product display area.

12. The product dispensing system of claim 11 further comprising a guide positioned proximate said rear end of said second support deck, said guide being configured to effect a vibration in said frame when a product engages said guide.

13. A product dispensing system comprising:

a container comprising a plurality of walls that define an internal volume, wherein one wall of said plurality of walls defines an opening into said internal volume, and wherein said one wall comprises at least two weakened severance lines extending from said opening to define an access panel in said one wall, wherein products are adapted to be stored within the internal volume of the container; and a dispenser comprising:

a frame having a front end and a rear end, the frame comprising a support deck, the support deck being configured to support the container, the support deck having a front end and a rear end, said support deck comprises a recess located between the front end and read end of the support deck, the recess being sized to receive said access panel, wherein the recess has a curved channel;

a product display area positioned below said support deck; and a catch element connected to said support deck proximate to the rear end of the support deck, said catch element protruding toward the front end of the frame to at least partially pass into the interior volume of the container through said opening, separate said access panel from said container along said weakened severance lines, and guide said separated access panel into the curved channel of the recess and toward the front end of the support deck when said container is moved along said support deck from said support deck front end toward said support deck rear end thereby causing the products adapted to be stored within the internal volume of the container to be dispensed out of the opening of the container.

* * * * *